US005209044A

United States Patent [19]

D'Addario et al.

[11] Patent Number: 5,209,044

[45] Date of Patent: May 11, 1993

[54] AUTOMATIC TUBE FILLING DEVICE AND PROCESS

[75] Inventors: James D'Addario, Westbury; Steven T. Murray, Oak Beach, both of N.Y.

[73] Assignee: Innovative Automation Inc., East Farmingdale, N.Y.

[21] Appl. No.: 728,613

[22] Filed: Jul. 11, 1991

[51] Int. Cl.[5] ..... B65B 3/04; B65B 55/24; B65B 57/02

[52] U.S. Cl. ..... 53/469; 53/51; 53/67; 53/272; 53/373.4; 53/505

[58] Field of Search ..... 53/544, 272, 271, 268, 53/469, 426, 506, 505, 69, 67, 51, 373.4, 77, 55

[56] References Cited

U.S. PATENT DOCUMENTS

| | | | |
|---|---|---|---|
| 2,693,901 | 11/1954 | Olson et al. | 53/544 X |
| 2,955,643 | 10/1960 | Shapero et al. | 53/373.4 X |
| 3,242,632 | 3/1966 | Dimond | 53/67 |
| 3,568,734 | 3/1971 | Vadas et al. | 141/89 |
| 3,825,043 | 7/1974 | Fechheimer | 141/147 |
| 3,918,236 | 11/1975 | Allen | 53/469 X |
| 4,355,495 | 10/1982 | Lewis et al. | 53/579 |
| 4,511,426 | 4/1985 | Linner | 156/497 |
| 4,606,382 | 8/1986 | Biller et al. | 141/1 |
| 4,607,252 | 8/1986 | Neri | 53/77 X |
| 4,614,073 | 9/1986 | Argazzi | 53/469 X |
| 4,629,017 | 12/1986 | Shroyer | 53/77 X |
| 4,768,327 | 9/1988 | Mosher | 53/51 |
| 4,809,481 | 3/1989 | Früh et al. | 53/55 |

OTHER PUBLICATIONS

Norden Packaging Machinery AB, Norden Packaging Machinery, 1989.

Norden Packaging Machinery AB, Nordenmatic 600 Automatic Tube Filling and Sealing Machine, 1989.

Norden Packaging Machinery AB, Technical Information, Hot Air Sealing Method For Laminate and Plastic Tubes, Sep., 1987.

Norden Packaging Company, Ten Tips For More Productive Tube Filling and Sealing.

Kalix, Kalix KX80 Automatic Tube Filling Machine.

Kalix, Kalix KX600 Automatic Tube Filling Machine, 1987 Tubes, Sep., 1987.

Unipac, Automatic Tube Filling and Closing Systems.

Unipac, Combi & Matic Tube Filling-Closing Machine.

Aktron, Inc., CO.MA.DI.S Automatic Tubefiller C120.

Aktron, Inc., CO.MA.DI. S Automatic Tubefiller C85, Tubes, Sep., 1987.

Iwka Packaging Machinery, Inc., The Program, 1987.

Iwka Packaging Machinery, Inc., The TFS 10 Tubefiller For Up to 60 Tubes/Minute, Sep., 1989 Tubes, Sep., 1987.

Packdevco Inc., Unipac Silver Series Tube Filling & Closing Machines.

Packdevco Inc., Letter Re Unipac Combi-Matic Silver 90 Automatic Tube Filling Machine, Mar. 15, 1990 Tubes, Sep., 1987.

Packdevco Inc., Letter Re Unipac Combi & Matic Automatic Tube Filling Machine, Apr. 5, 1985.

*Primary Examiner*—James F. Coan

*Attorney, Agent, or Firm*—Hedman, Gibson & Costigan

[57] ABSTRACT

An automated tube filling machine and process having a plurality of work stations, a rotating disc to deliver the tubes to the work stations and a central processing unit to control implementation of the work stations and rotation of the disc.

30 Claims, 16 Drawing Sheets

AUTOMATIC TUBE FILLING DEVICE AND PROCESS

FIELD OF THE INVENTION

The present invention relates to a device and process for filling tubes. More particularly, the invention relates to automated tube filling mechanisms and processes.

BACKGROUND OF THE INVENTION

It has long been customary to merchandise many products in tubes. Typical products packaged in tubes include toothpaste, lotion, caulking compound, etc.

As a result a significant industry exists in filling tubes. Currently, tube filling is generally performed by automated machinery.

Rotary piston tube filling machines are probably the most common machinery now in use for filling tubes. Typical examples of rotary piston tube filling machines are shown in U.S. Pat. No. 2,958,346 and U.S. Pat. No. 3,825,043, which are incorporated herein by reference thereto. Additionally, such machines are currently manufactured by Norden Packaging Machinery AB, Kalix Inc., Iwk Packaging Machinery, Inc. Pack. Dev. Co. Ltd. and Aktron, Inc.

Typically, rotary tube filling machines are mechanically driven by cams and chains. The tubes travel on conveyors or rotating discs to various work stations required to perform the functions necessary to fill a tube. The various functions include loading the empty tubes on the conveyor or disc in proper orientation, cleaning the interior of the empty tubes, filling the tubes, sealing the filled tubes and discharging the filled tubes from the conveyor or disc. However, with the conventional tube filling machinery, each time a new tube is used or a different fill substance is utilized, the cams and chains must be adjusted to accommodate the varying heights and angles of the tubes, the orientation marks, the time and temperature associated with sealing different tubes and the time needed to fill the tubes. Adjustment of the cams and chains is time consuming and tends to create contamination problems because of the need to oil and grease various components. Thus, after the necessary adjustments are made, time must be spent cleaning the machine to insure that the oil and grease do not come into contact with the tubes or the tubes must be cleaned before the packaging occurs. Another problem with cams is the wear associated with normal use that can cause shifting of the tubes during travel on the conveyor or disc.

Further, current tube filling machinery lacks the capacity to afford determination of adjustment corrections at the individual stations. Typically, the entire machine must be activated to be able to check any single function.

BRIEF DESCRIPTION OF THE INVENTION

It is an object of the present invention to provide an apparatus and process for rapidly and efficiently filling tubes of various sizes and dimensions.

It is a further object of the present invention to provide a mechanism and process for filling tubes that avoid or minimize the delays from inadvertent spills and mis-alignments that typically occur in a rapid tube filling operation.

To this end, an apparatus is provided comprised of a rotating disc having a plurality of stations in which filling functions associated with the filling of tubes on a production basis occur. The disc is provided with a plurality holes in which tube filling support means are inserted to retain the tubes and enable simultaneous operations at a plurality of stations. The disc is provided with plastic collars at each hole to accommodate the tube support means for both rotation and secure placement. Work stations are provided in registry with the rotating disc and comprise a means for loading tubes into the tube holders, means for properly registering and determining registration and orientation of the tube for subsequent functions, reject means, cleaning means, filling means, sealing means, trimming means, and tube eject means.

The process of the invention proceeds by simultaneously loading an empty tube bottom up with a tube filling opening presented upwardly, orienting the previously loaded tube, rejecting any previously improperly oriented tube, cleaning the oriented tubes, filling the oriented tubes and sealing, trimming and ejecting the filled tubes.

A pneumatic actuation system is provided to implement the various functions and an array of sensors are located strategically in the apparatus to provide signals to a central processing unit that controls the function and operation of FIG. 1.

DESCRIPTION OF THE PREFERRED EMBODIMENT

Figure 1:
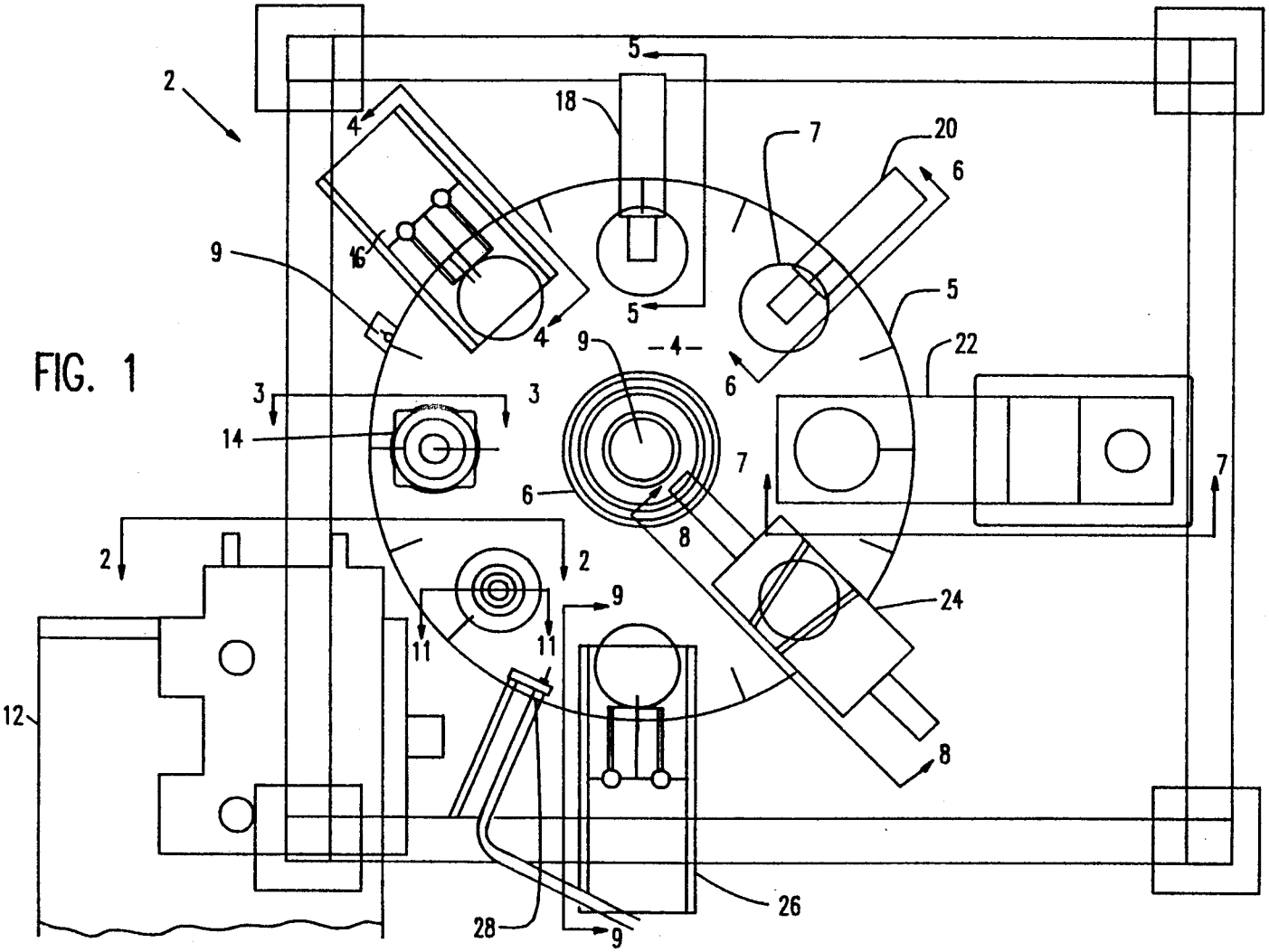
FIG. 1 is a plan view of the tube filling machine of the subject invention.

The filling machine 2 of the subject invention is shown in plan in FIG. 1. In essence the filling machine 2 is comprised of a circular disc 4 mounted on a centrally disposed indexing motor 6 and a plurality of work station assemblies.

The disc 4 has an outer edge 5 and is provided with a plurality of identically sized holes 7 located at the same radial distance from the center 9 of the disc 4. A Delrin sleeve 13 having a bearing surface 19 is secured around the periphery on the inner surface of each hole 7. A cylindrical tube support member 8 adapted to carry a tube holder 10 is slidably mounted in each hole 7.

The circular disc 4 is mounted on the indexing motor 6 to move each of the tube holders 10 from an initial tube loading location throughout a plurality of stages to a final filled tube ejection station. The bottom surface of the circular disc 4 is provided with marks which enable a photoelectric sensor to accurately align the holes 7 with the work stations.

The stations are comprised essentially of a tube loading station 12, an orientation station 14, a reject station 16, a tube cleaning station 18, the filling station 20, a tube sealing station 22, a tube trimmer station 24 and a filled tube eject station 26. A detector 28 is provided after the filled tube eject station 26 to insure that a filled tube that inadvertently travels beyond the filled tube eject station 26 does not interfere with the normal operation of the filling machine 2. When the detector 28 detects the presence of a tube 32 the filling machine 2 will stop until the tube 32 is removed and the start button is manually pressed to restart the filling machine 2.

Figure 2:
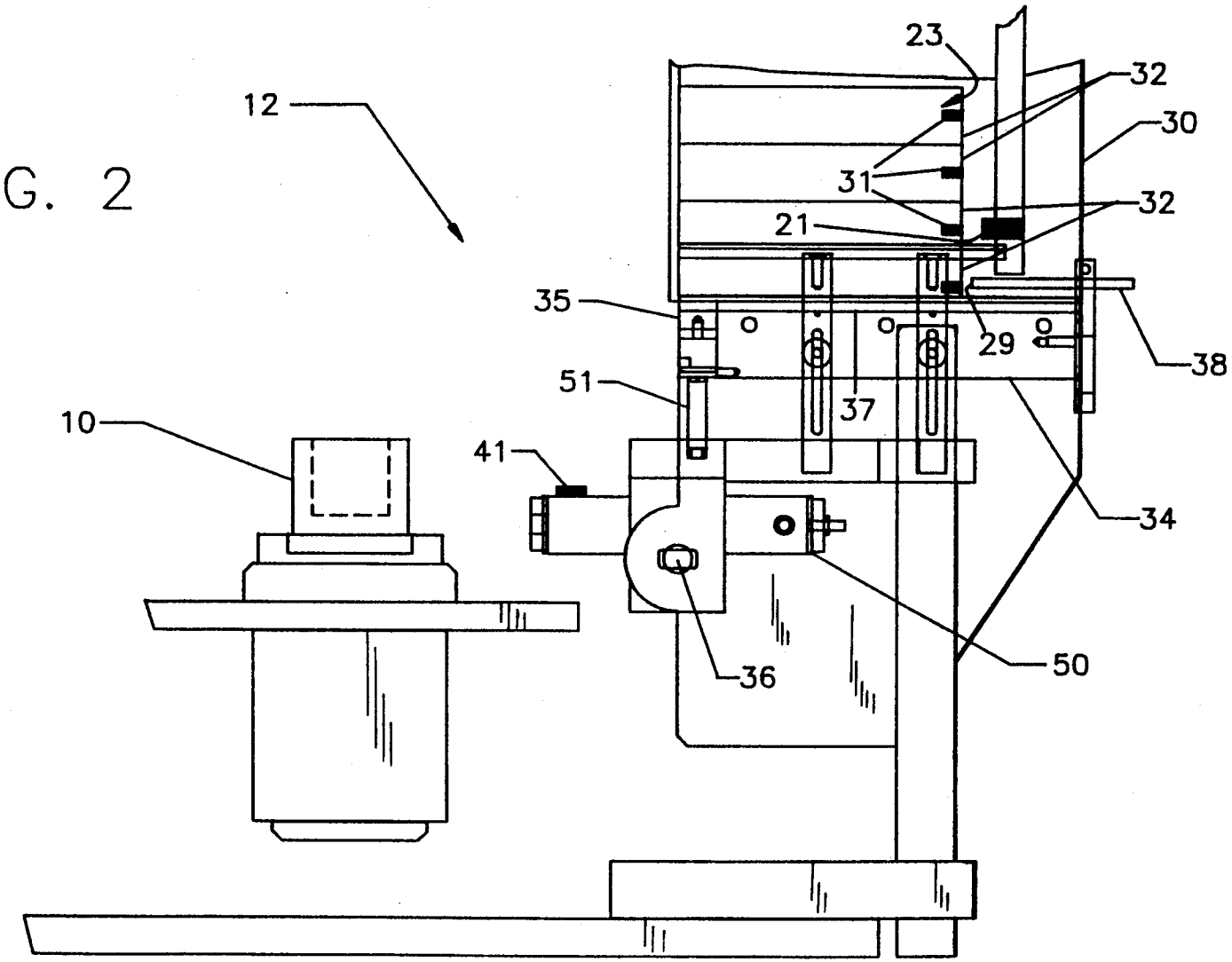
FIG. 2 is a sectional elevational view through line 2—2 of the tube loading assembly of the filling machine of FIG. 1.

The tube loading station 12 best seen in FIG. 2 is comprised of an inclined feeder 30 that delivers empty open cylindrical tubes 32 to the tube loading station 12, a sensor 21 to determine if a tube 32 is available and that the tube 32 is correctly positioned for feeding, a vee-block carriage 34 for delivery of the empty tube 32 to the tube holder 10 in the tube loading station 12, a pivotal mount 36 that mounts the vee-block carriage 34, a pneumatic actuator 50 (or alternatively a rack and pinion) for rotating the vee-block carriage 34 around the pivot 36 and a separate pneumatic line 38 terminating in a tube setting nozzle 29 for positively inserting the empty tube 32 in the tube holder 10. It has been found in practice that the tube 32 should be force fit into the tube holder 10 to achieve the proper seating required for each of the functional operations throughout until ejection of the tube. The carriage 34 is provided with a clamp mechanism 35 controlled by an actuator 51 to grip the empty tube 32 as the empty tube 32 enters the carriage support surface 37. A sensor 41 is provided to detect the carriage 34 in the vertical tube loading position. The clamp mechanism 35 releases the empty tube 32 when the tube 32 is inserted in a tube holder 10 and the setting nozzle 29 is activated when the sensor 41 has been energized to signal the CPU 3.

Figure 3:
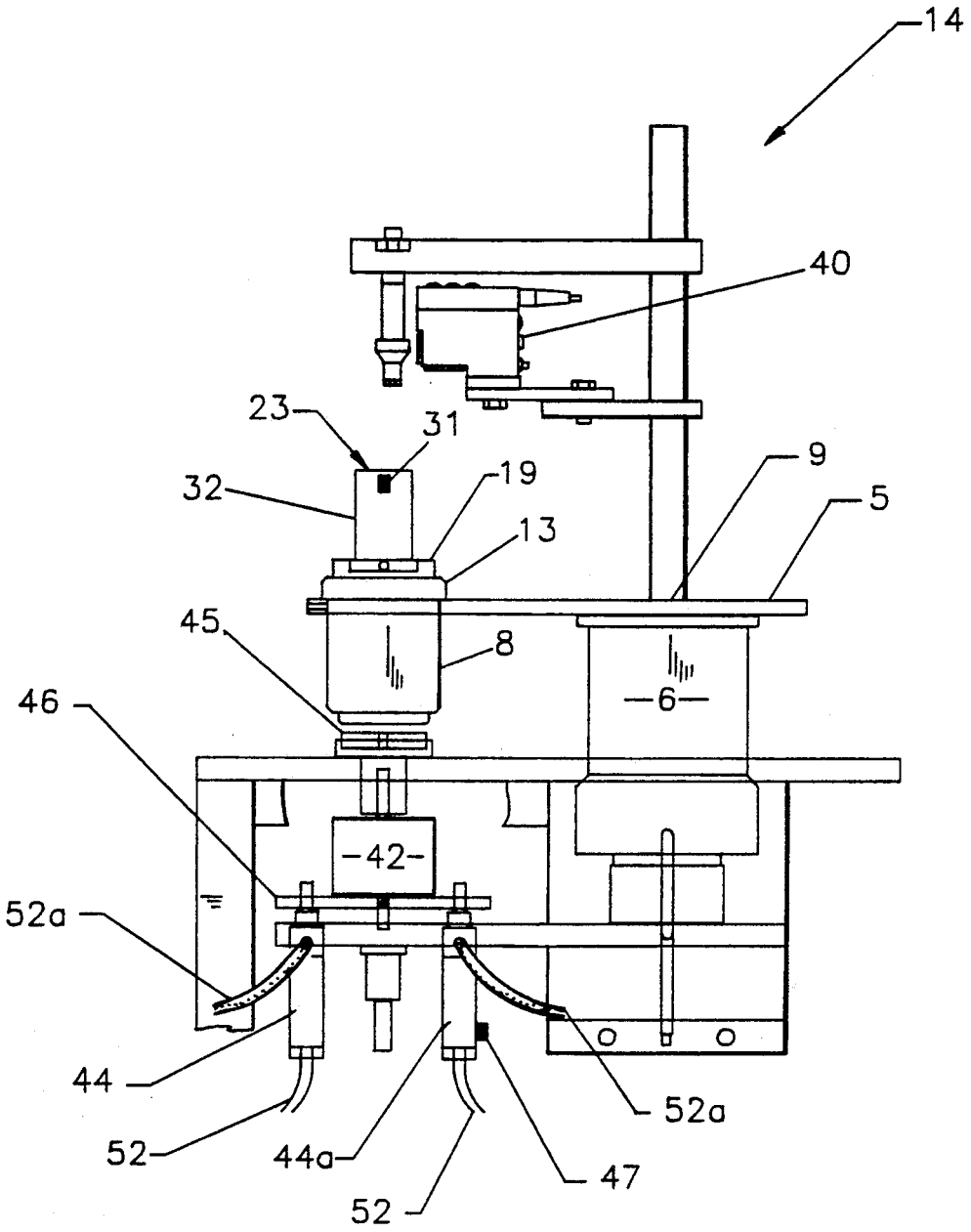
FIG. 3 is a sectional elevational view through line 3—3 of the registration assembly of the filling machine of the FIG. 1.

The orientation station 14 is best seen in FIG. 3 and is comprised of a conventional electronic eye detection assembly 40, a stepper motor 42, two air cylinders 44 and 44*a* and a sensor 47. The stepper motor 42 is mounted on a plate 46 and adapted to be elevated by the two air cylinders 44 and 44*a*, wherein the rotating motive surface 45 comes into contact with the bottom of the cylindrical tube support member 8 and upon a signal from the computer rotates the cylindrical support member 8 with the empty tube 32 in view of the electronic eye detector 40. Each tube 32 will have an orientation mark 31 that the eye detector 40 seeks to determine if the orientation of the empty tube 32 is proper for the subsequent functions. The stepper motor 42 rotates the tube 32, while the eye detector 40 looks for the orientation mark 31. When the eye detector 40 detects the mark 31, the stepper motor 42 stops and returns to its inoperative position. If after a predetermined period of time a mark 31 is not detected the stepper motor 42 is also returned to its inoperative position and a flag is set in the CPU 3. Sensor 47 detects the return of the stepper motor 42 to its inoperative position.

Figure 4:
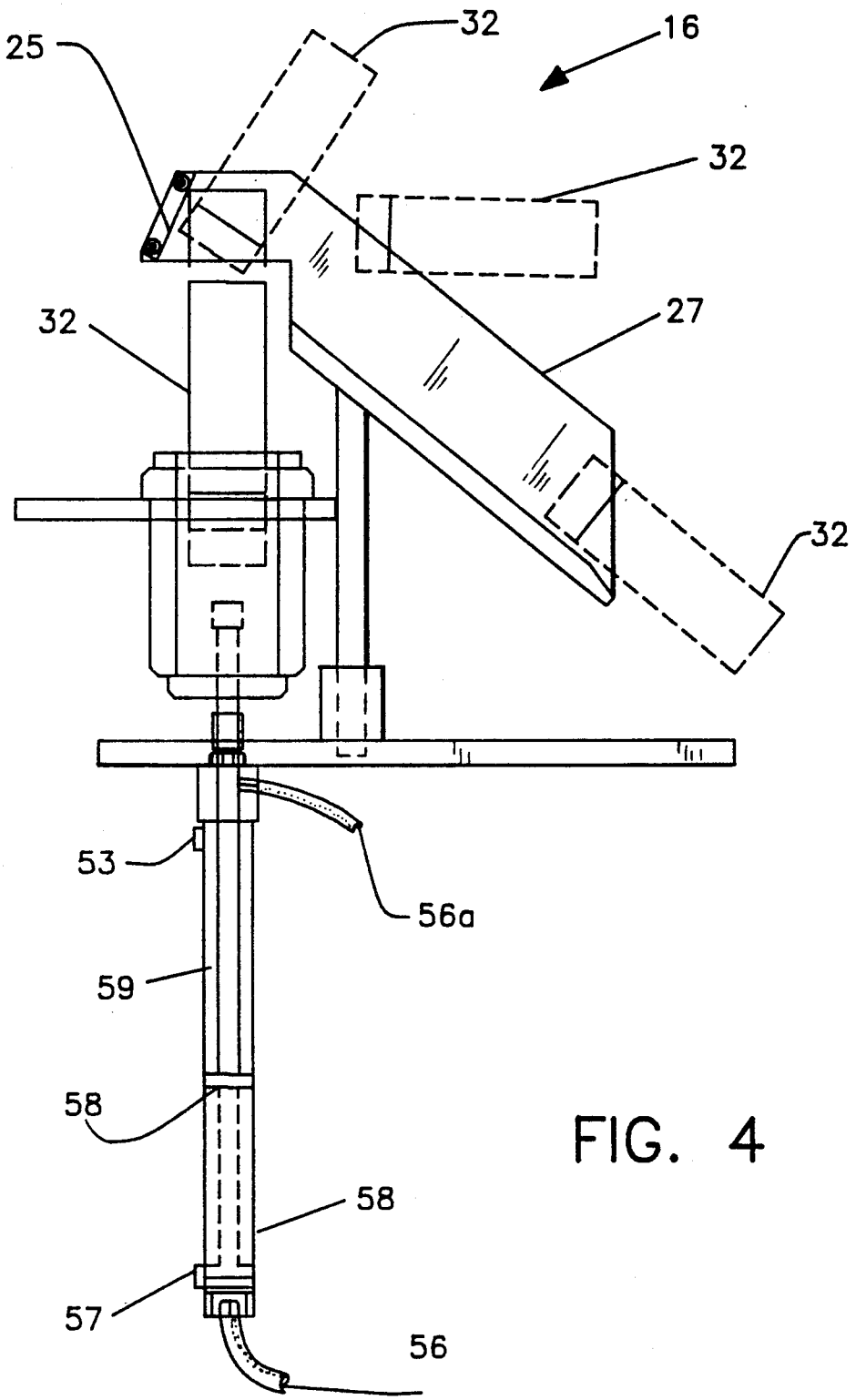
FIG. 4 is a sectional elevational view through line 4—4 of the rejection assembly of the filling machine of FIG. 1.

The reject station, 16 is best seen in FIG. 4 and is pneumatically controlled. The reject station 16 consists essentially of a pneumatically operated actuator piston 58 that moves a piston rod 59 vertically to reject improperly oriented tubes 32 upon command from the CPU 3. Pneumatic lines 56 and 56*a*are provided to energize the piston 58 upwardly and downwardly upon command from the CPU 3 by opening and closing a valve in response to computer commands. A sensor 53 detects the up position of the piston 58 and a sensor 57 detects the down position of the piston 58. The piston rod 59 raises the tube 32 so that the tube 32 comes in contact with the deflector 25 and the tube 32 proceeds down the chute 27.

Figure 5:
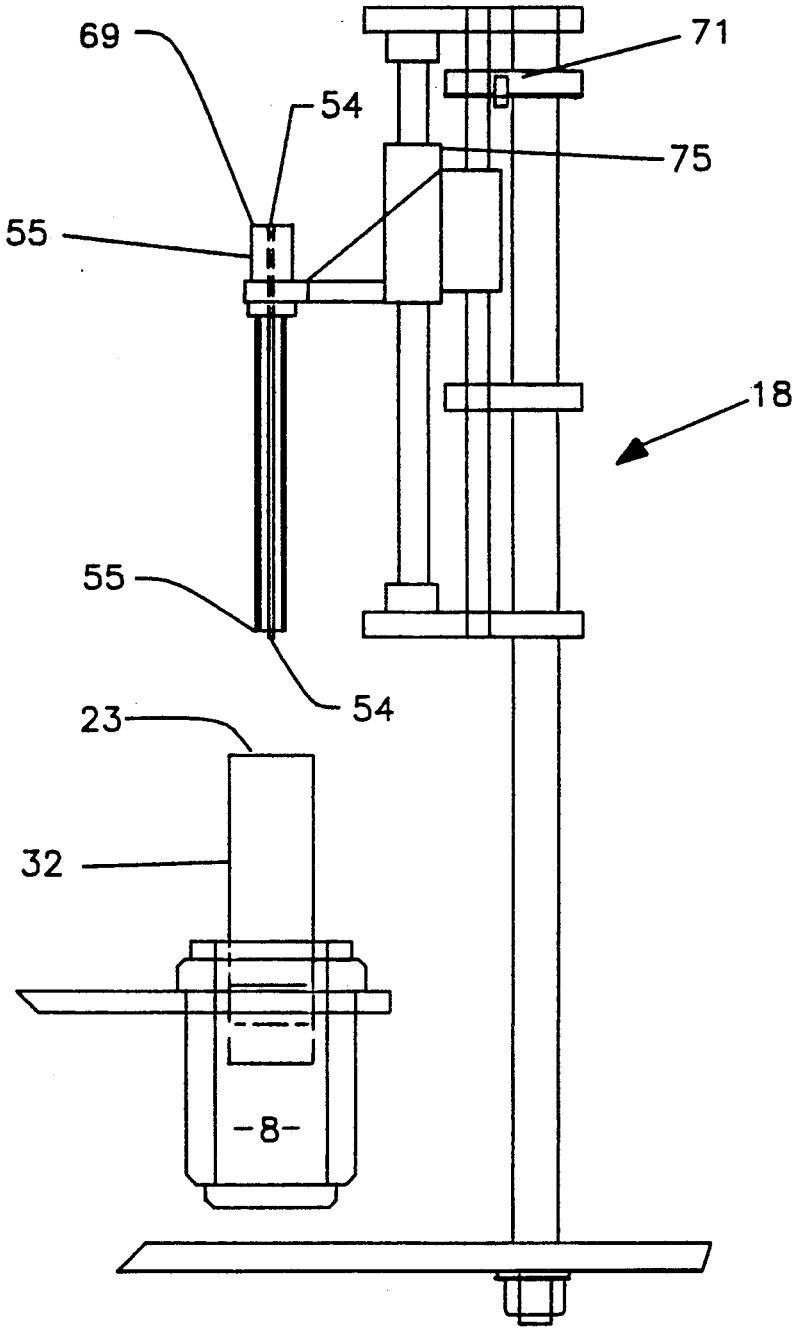
FIG. 5 is a sectional elevational view through line 5—5 of the cleaning assembly of the filling machine of FIG. 1.

The cleaning station 18 best seen in FIG. 5 is comprised of a cleaning nozzle 69 which has a blowing line 54 and an evacuation line 55. The blowing line 54 is set to deliver a predetermined amount of air per second while simultaneously vacuuming through the evacuation line 55 to facilitate cleaning of each tube. The cleaning nozzle 69 is moved in a vertical position by an actuator 75. A sensor 71 detects the up position of the cleaning nozzle 69. The cleaning apparatus of cleaning station 18 can consist of a conventional blower/vacuum device manufactured by Mighty-Vac, Venturi, or Pro-Tech Manufacture Co., Inc.

Figure 6:
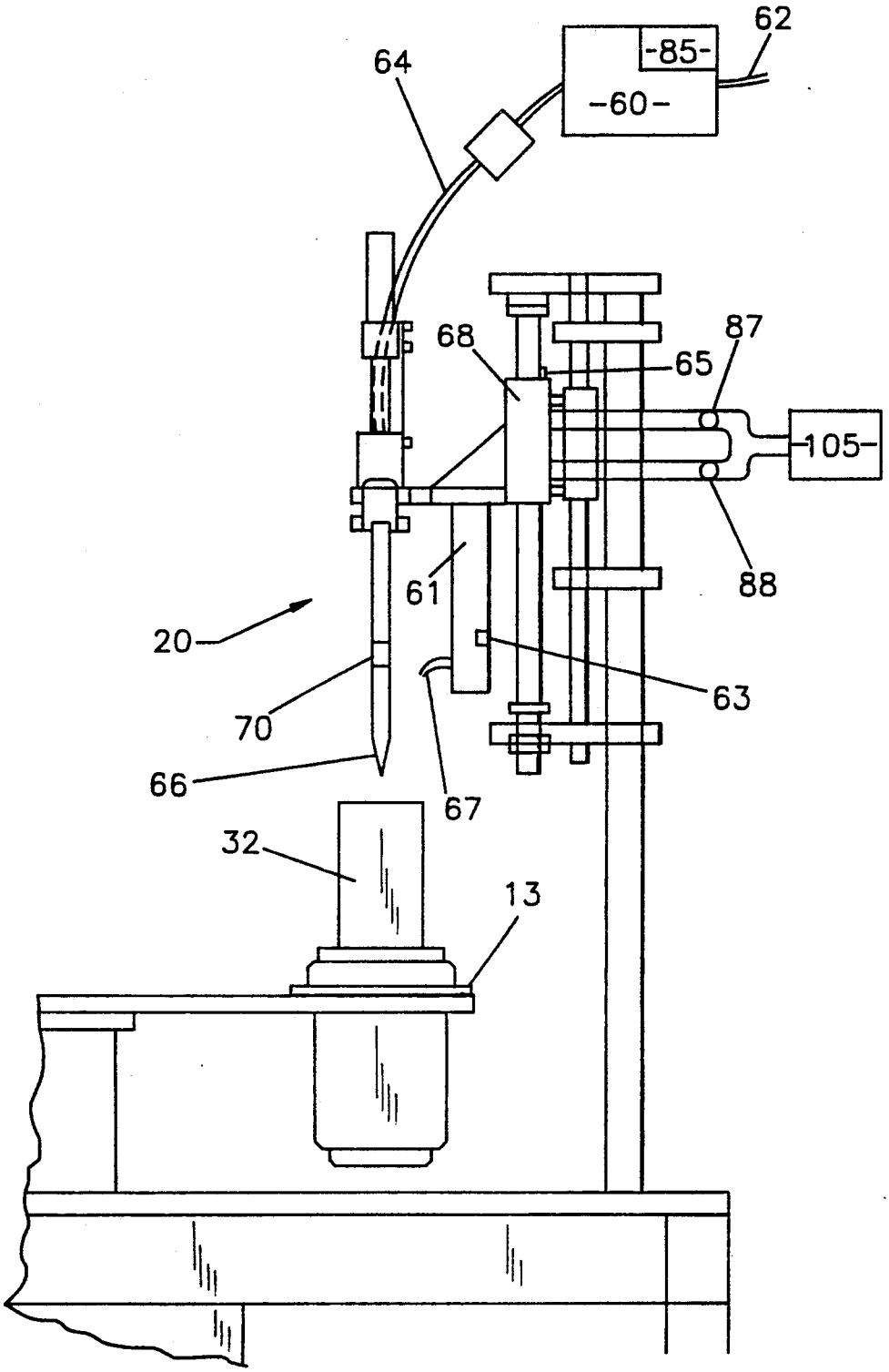
FIG. 6 is a sectional elevational view through line 6—6 of the filling assembly of the feed filling machine of FIG. 1.

The filling station 20, best seen in FIG. 6 is comprised of a pump 60 having an inlet hose 62, an outlet hose 64 and a nozzle 66 mounted for vertical movement. The nozzle 66 is mounted on a carriage 68 that is pneumatically elevated and depressed by an actuator 61 as a function of the (CPU 3) computer commands. The sensor 63 detects the presence of the carriage 68 when it is lowered into a tube 32. Sensor 63 signals to the CPU to open valve 70 in the nozzle 66. The CPU 3 also signals the computer driven motor controller 85 to turn on the motor to drive the pump 60. The computer driven motor controller 85 sends out the information relating to the speed of rotation, fill time and fill weight. The opening of the valve 70 allows fluid from the pump 60 to be delivered through the outlet hose 64 and the nozzle 66 to fill the tube 32. Upon the filling of the tube 32, by measurement of a pre-determined amount, a command from the computer closes the valve 70 and elevates the nozzle carriage 68 out of registry with the tube 32. The sensor 65 detects the presence of the carriage 68 when it is raised to the rest position.

Figure 7:
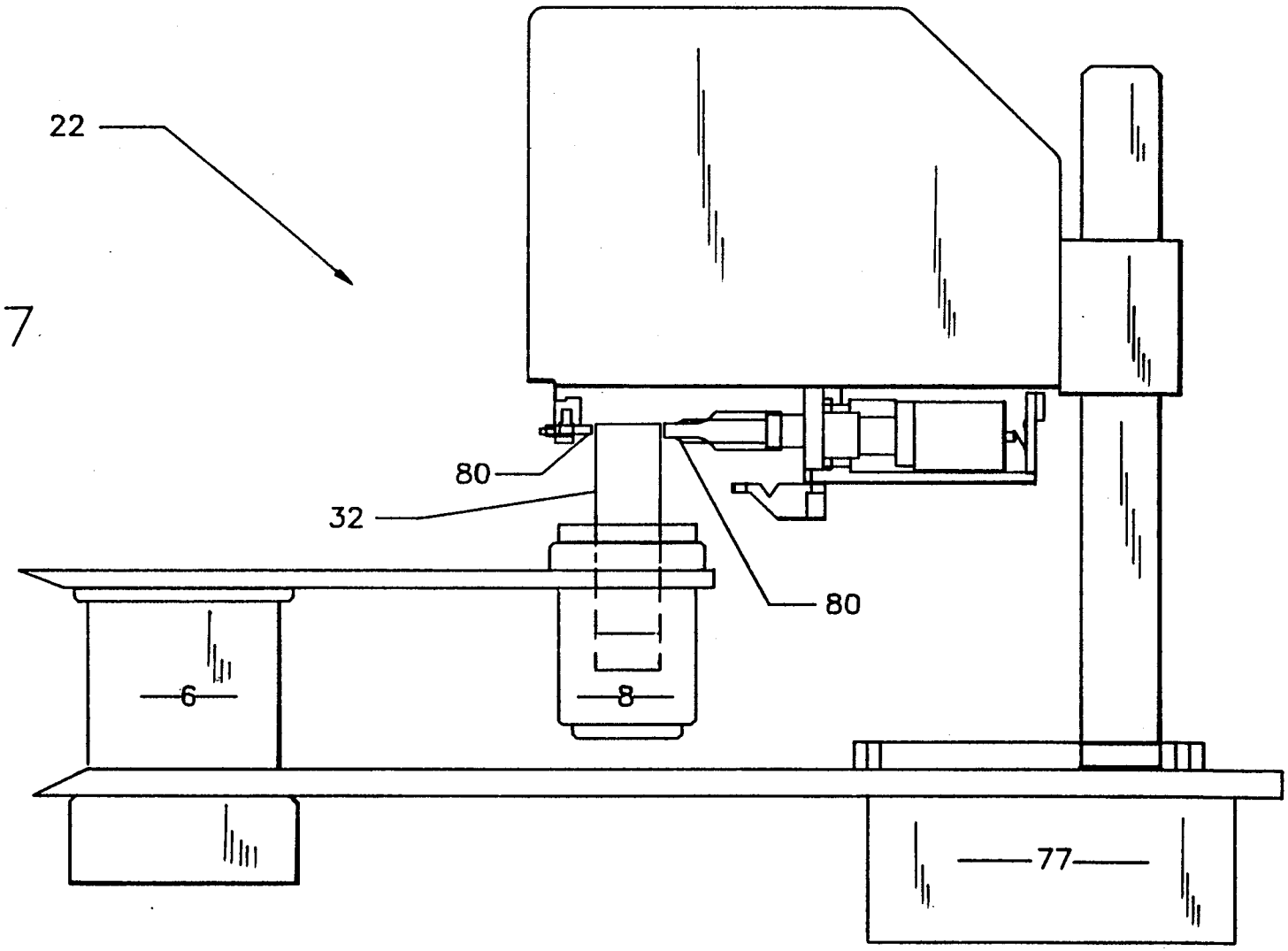
FIG. 7 is a sectional elevational view through line 7—7 of the sealing assembly of the filling machine of FIG. 1.

The sealing station 22, best seen in FIG. 7, is comprised in essence of a conventional sealer mechanism typically manufactured by AMTECH. The AMTECH sealing mechanism has its own central processing unit 77 which controls the movement of the jaws 80 and the length of time the jaws 80 are engaged. Variables regarding this information are programmed into the CPU 77 of the sealer mechanism. The sealer mechanism has ultrasonic frequency jaws 80 that, upon a signal from the main computer 3 to the sealer mechanism computer 77, clamps the top of the tube 32, and emits ultrasonic sound waves causing the molecules to vibrate, drift together and solidify. When the sealing process is complete the sealer mechanism computer 77 sends a signal to the main computer 3.

Figure 8:
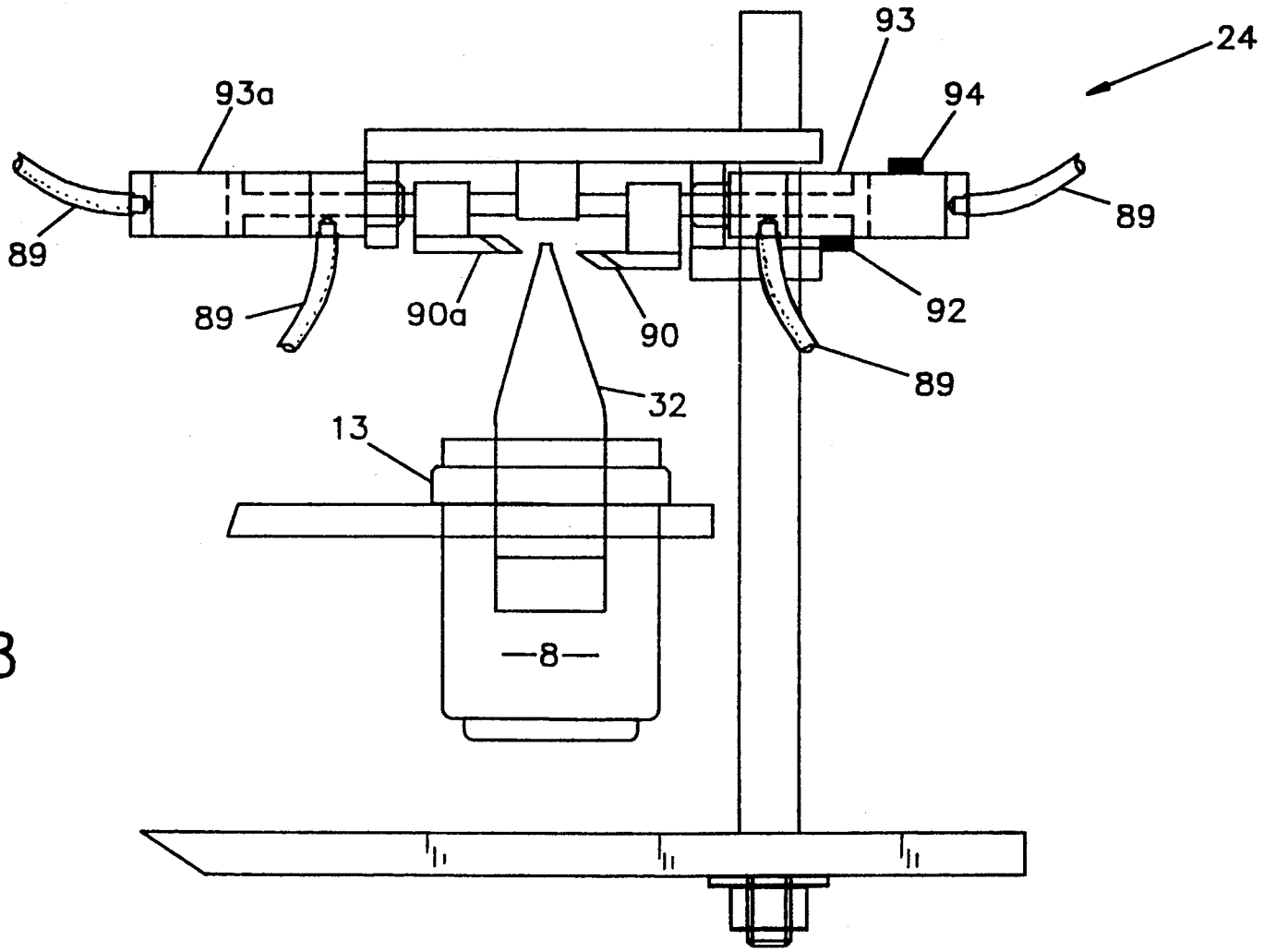
FIG. 8 is a sectional elevational view through line 8—8 of the trimmer assembly of the filling machine of FIG. 1.

The trimming mechanism 24 is best seen in FIG. 8 and is comprised of clipping jaws 90 and 90a that respond to a command of the computer 3 to open and close upon pneumatic actuation. There are two sensors 92 and 94 associated with either jaw 90 or 90a. The pneumatic actuators 93 and 93A open and close the jaws 90 and 90a. The location of the jaws 90 and 90a is determined by two sensors 92 and 94 which are associated with one of the actuators 93 or 93A.

Figure 9:
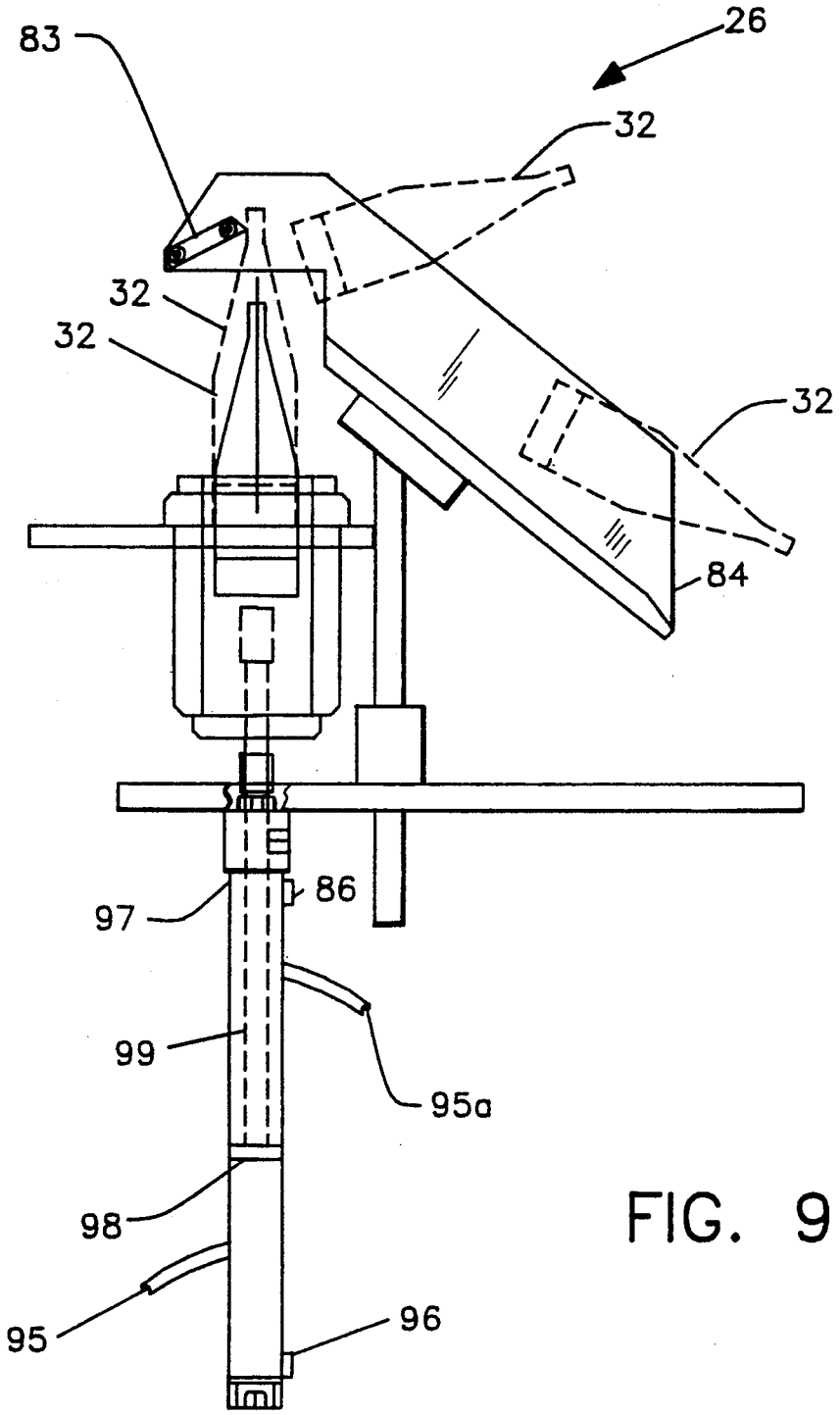
FIG. 9 is a sectional elevational view through line 9—9 of the ejection assembly of the filling machine of FIG. 1.

The ejection stage 26 best seen in FIG. 9, consists of a vertically mounted piston actuator 97 that is pneumatically controlled to eject the filled tube 32. The piston 98 in the actuator 97 travels upwardly to force the piston rod 99 to forcibly engage the bottom of the tube 32 and thereby eject the tube 32 outwardly over the edge 5 of the circular disc 4. A sensor 96 determines the location of the piston 98 to insure that it has returned to the rest position. A sensor 93 determines that the piston 98 is in the raised position. The piston 98 raises the tube 32 so that the tube 32 comes in contact with the deflector 85 and the tube 32 proceeds down the chute 84.

The main computer 3, the sensors and the pneumatic system 100 all work in conjunction to control the functions of the filling machinery.

Figure 10:
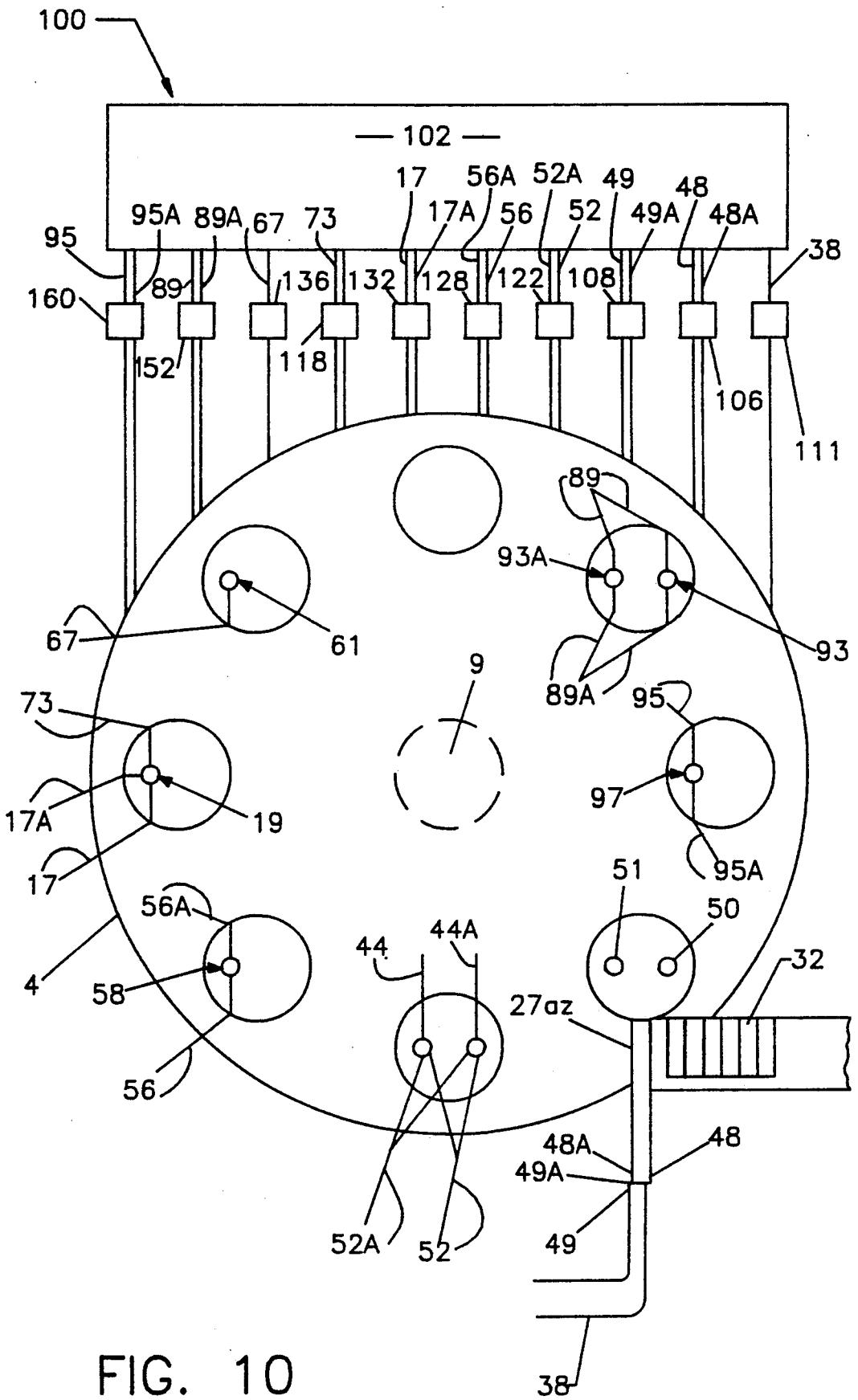
FIG. 10 is a schematic view of the pneumatic actuation and computer control assembly of FIG. 1.

The pneumatic system 100 shown schematically in FIG. 10, is comprised of pneumatic lines extending from an air source 102 to perform twelve functions. Each of the pneumatic lines is provided with an open/-close valve. Practice has shown that single and double solenoid air valves of the type manufactured by Norgen are suitable. The air source 102 is comprised of a compressor pump set to provide a constant 80–90 psi of air pressure. A pneumatic line 48 with a single solenoid valve 106 extends from the air pressure source 102 to the actuator 50 side of the tube loading vee-block carriage 34. The other side of the pneumatic line 48A is arranged to extend to the tube loading veeblock carriage actuator 50 return side to return the tube loading vee-block carriage 34 to the original tube receiving position. Another loading vee-block line 38 with a single solenoid valve 111 extends to the tube loading veeblock carriage 34 and terminates in the tube setting nozzle 29 that is energized when the clamp 35 is released. The pneumatic lines 49 and 49A with a single solenoid valve 108 extend to the actuator 51 for clamping the tube 32 prior to the pivoting of the tube loading vee-block carriage 34.

Pneumatic lines 52 and 52A with single solenoid valve 122, extend from the air source 102 to the actuators 44 and 44A of the stepping motor 42 to elevate the stepping motor 42 into contact with the bottom surface 178 of the cylindrical tube support 8.

Pneumatic lines 56 and 56A with double solenid valve 128 extend to the actuator 58 of the reject line piston rod 59 and perform the functions of energizing the reject piston rod 59 to facilitate discharge of the reject tube and return of the piston rod 59 to the rest position.

Pneumatic lines 17 and 17A with single solenoid valve 132 extend to the actuator 75 of the cleaning nozzle 69 to perform the function of raising and lowering the cleaning nozzle 69. Pneumatic line 73 with single solenoid valve 118 terminates in the cleaning nozzle 69 enabling the blowing line 54 of the nozzle 69 and evacuation line 55 to function.

The pneumatic line 67 with valve 136 extends to the fill carriage actuator 61 of the filling station 20 and is arranged to positively depress the fill nozzle carriage 68; the line 67A being arranged to return the fill nozzle carriage 68 to its original position. The pneumatic lines 74 and 74A with single solenoid valve 144 operate to open and close the valve in the feed delivery line to the nozzle 66.

The pneumatic lines 89 and 89A with double solenoid valve 152 operate to open and close the jaws 90 and 90A of the trimmer by actuation of the actuator 93 and 93A.

The pneumatic lines 95 and 95A with double solenoid valve 160 are provided to selectively actuate the discharge piston 98 in the actuator 97 and discharge the filled tube 32 from the discharge assembly.

Figure 11:
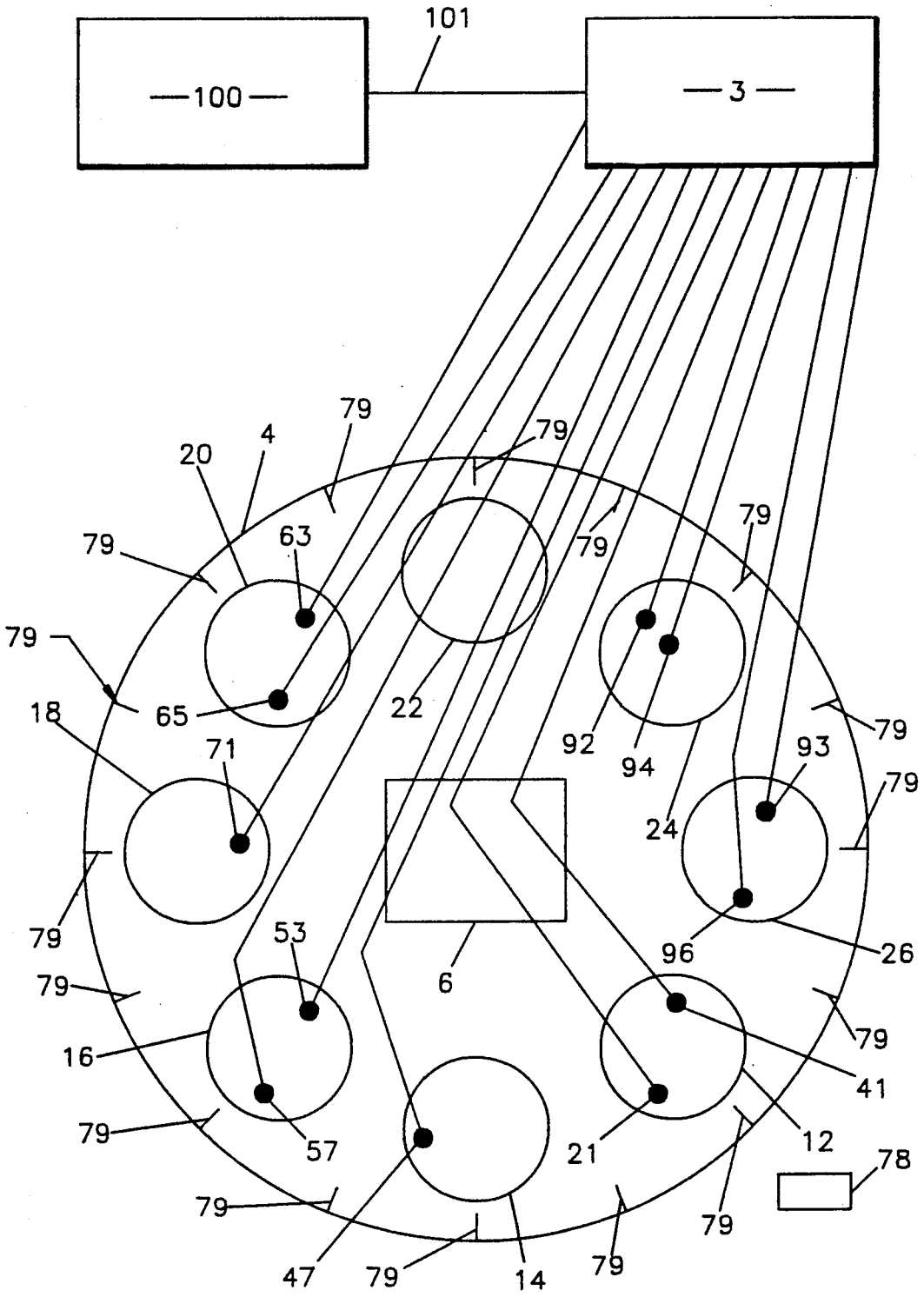
FIG. 11 is a bottom plan view of the rotating disc of the invention.

The sensor controls of the apparatus 2 can be seen in FIG. 11. The main central processing unit 3 receives input from the sensors that are located at the various stations. As a result of the input signals the main computer 3 sends out signals to the pneumatic system 100, via cables 101. Prior to initiating the indexing the disc 4 the main computer 3 checks to certify that the equipment located at each of the stations is in the appropriate inoperative or rest position to ensure that the functioning apparatus at the work stations will not interfere with movement of the disc 4.

As can be seen from FIG. 11, the loading station 12 has two sensors. Sensor 21 ensures that tubes 32, are present at the loading station 12 and that the tubes 32 are correctly positioned with the open end up for filling. Sensor 41 signals to the main computer 3 that the veeblock loading carriage 34 is in a vertical position. The main computer 3 signals the pneumatic system 100 to release of the clamping mechanism 35 and positively sets the tube 32 by blasting air from the setting nozzle 29 when the vee block carriage 34 is in the vertical position.

The orientation station 14 is provided with a sensor 47 for indicating to the main computer 3 that the stepper motor 42 has returned to its original position.

The reject station 16 is provided with two sensors. The first sensor 53 indicates that the piston 59 is in the up position and that the tube 32 has been ejected. Sensor 53 signals to the double solenoid valve 128 to switch causing the piston rod 59 to return to its original position. When the piston rod 59 returns to the original or rest position, sensor 57 signals the main computer 3 indicating that this rejection is complete.

The cleaning station 18 is provided with a sensor 71 which informs the main computer 3 that the cleaning nozzle 69 has completed cleaning and has returned to the original rest position.

The filling station 20 is provided with two sensors 63 and 65. When the fill nozzle 66 is in the down position the sensor 63 signals the main computer 3 to open the fill nozzle 66 and activate the pump motor 60. Upon completion of the filling function, the fill nozzle 66 returns to the inactive or rest position causing the sensor 65 to indicate to the main computer 3 that the filling function is complete.

The trimming station 24 is provided with two sensors 92, and 94 associated with either jaw 90 or 90A. When the jaws 90 and 90A are fully extended the sensor 92 signals the double solenoid valve 152 to enable the retraction of the jaws 90 and 90A. Upon retraction of the jaws 90 and 90A, the sensor 94 informs the main computer 3 that the trimming is complete.

The ejection station 26 is controlled by two sensors 86 and 96. The first sensor 86 signals to the double solenoid valve 160 that the eject piston rod 99 is in the up position and initiates the return of the eject piston rod 99. When the eject piston rod 99 returns to its original position, the sensor 96 signals the main computer 3 indicating that the eject function is complete.

The main computer 3 will not index the circular disc 4 allowing the tubes to rotate to the next position until it receives signals from the sensors, 47, 57, 71, 65, 94, and 96 and the sealing mechanism central processing unit 77 that each of the functions are complete and all of the equipment is in the appropriate rest position.

Figure 12:
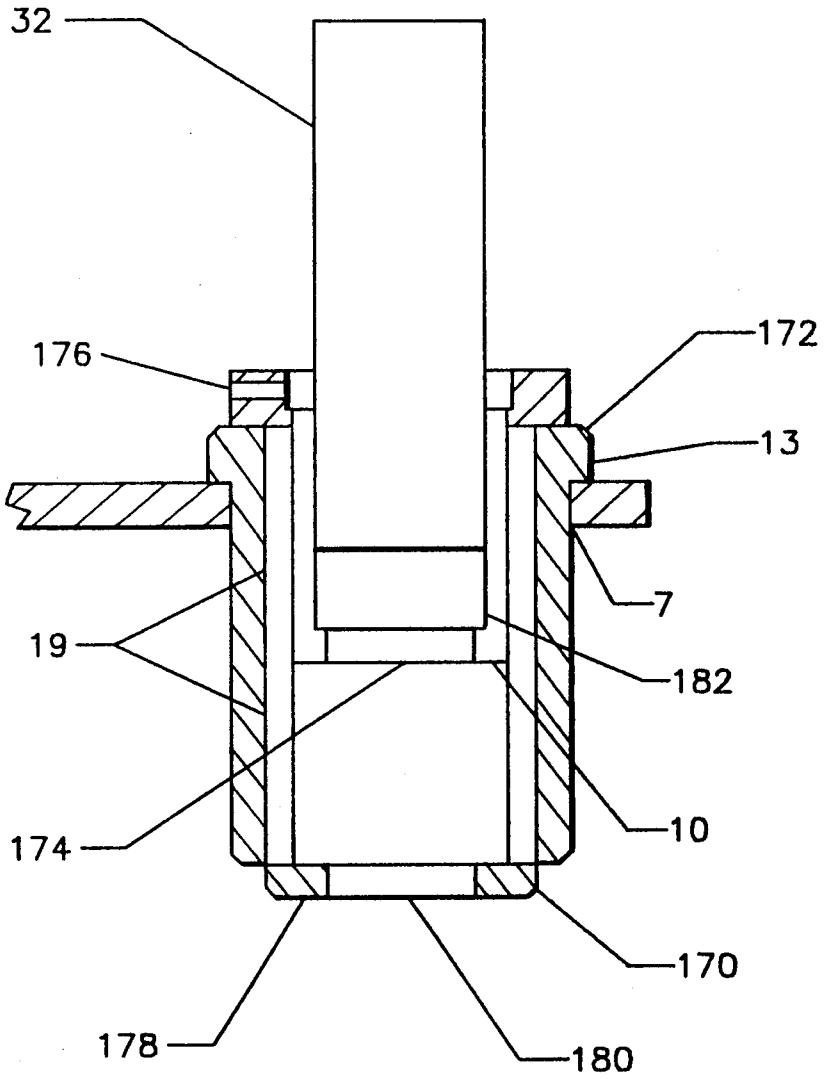
FIG. 12 is a sectional elevational view through line 11—11 of FIG. 1.

As best seen in FIG. 12, the cylindrical tube support member 8 is comprised of a cylindrical body 170, a flange collar 172 and a centrally disposed top opening 174 in which the tube holder 10 is secured by means such as a set screw 176. The bottom 178 of the cylindrical body 170 is flat to cooperate with the rotating motive surface 45 of the stepper motor 42. A centrally disposed hole 180 is located in the bottom 178 of the hollow cylindrical body 170 and a centrally disposed top opening 174 is provided to enable the reject piston 58 and the eject piston 98 to pass through the cylindrical body 170 and have access to the tube 32 mounted in the tube holder 10.

The cylindrical tube support member 8 is sufficiently heavy to remain in fixed registry on a flange 172 after positioning at the orientation station 14. In practice it has been found that a cylindrical tube support member 8 of aluminum weighing 1 lb 7 oz having a 3.5 inch wide flange plastic bearing surface 19 thirty two square inches ($\pi DL = \pi$ (2.813) (3.625)) wide provide a condition wherein the disc 4 can rotate at the speed of 45°/0.25 seconds without experiencing any rotational movement of the cylindrical tube support 8 after orientation at the registration station 14.

The tube holder 10 is circular to fit within the top opening 174 of the cylindrical tube support member 8 and is secured by the set screw 176. An opening 182 in the tube holder 10 is aligned with the hole 180 in the bottom of the cylindrical support 8 to enable passage of the reject piston 58 and the eject piston 98.

The process of filling a tube 32 is controlled by a main CPU 3. When power is initially supplied to the CPU 3 and prior to each time the disc 4 indexes the CPU 3 checks the sensors at the various stations to insure that the components of each station are correctly positioned. Once this has been determined, the circular disc 4 is turned to a "Home" position. The Home positioning occurs by a photoelectric sensor 78 detecting the marks 79 on the bottom surface of the circular disc 4 to accurately align the holes 7 in the circular disc 4 with the work stations. Initial flags are set to alert the work stations when to start their respective functions. Each of the stations are functioning simultaneously. The sensor system insures that rotation of the disc 4 does not occur until all of the functions are completed. Typically, rotation of the disc 4 occurs every ¾ to 1½ seconds depending on the tube being filled; the limiting function of the overall process usually but not always being the time required to fill the tube. When the start signal is initiated from the control panel, the stations begin operation. Empty, open, cylindrical tubes 32 are fed down the inclined feeder 30 to the vee-block carriage 34. A sensor 21 determines if a tube 32 is present on the vee-block carriage 34 for loading and if the open end 23 of the tube 32 is correctly positioned. The clamping mechanism 35 secures the tube 32 to the vee-block carriage 34 and the vee-block carriage 34 is then rotated with the tube 32 into a vertical position. A sensor 41 detects that the carriage 34 is in the up position, and signals the CPU 3 to release the clamping mechanism 35 and the tube setting nozzle 29 blasts air into the tube 32 for a predetermined period of time—approximately 0.2 seconds—to positively position the tub 32 into the tube holder 10. The vee-block carriage 34 is then rotated back into its horizontal position and the next tube 32*a* moves onto the vee block carriage 34 for loading.

Once all the tasks are completed, the main CPU 3 signals the controller of the circular disc 4 to rotate the circular disc 4 so that the loaded tube is positioned at the next station—the orientation station 14.

Simultaneously, with the loading function, the previously loaded tube 32 in the orientation station 14 is oriented to the desired position. The main CPU 3 sends a signal to the pneumatic system 100, which activates the two cylinders 4 and 44*a* that elevate the stepper motor 42 so that the rotating surface 45 of the stepper motor 42 comes into contact with the bottom of the tube support member 8. The CPU 3 also signals the controller of the stepper motor 42 to begin rotating. The stepper motor 42 rotates the tube support member 8 until the electronic eye sensor 40 detects the orientation mark 31 on the tube 32 or a predetermined amount of time, i.e. 0.5 seconds, has elapsed. When the electronic eye 40 senses the mark 31 or the time period has elapsed, the stepper motor 42 stops rotating and is retracted to its original rest position. A sensor 47 detects the return of the stepper motor 42 and signals the main CPU 3 that this station has completed its task and will not interfere with the rotation of the disc 4.

If in the orientation station 14 the electronic eye 40 is unable to detect the orientation mark 31, a flag is set in the main CPU 3 which initiates the reject station 16. Thus, when the circular disc 4 rotates each tube 32 to the next station, an unoriented tube 32 at the reject station 16 is rejected by the pneumatically operated piston 58. A sensor 53 detects that the piston 58 is in a raised position and signals to the double solenoid value 28 to switch which lowers the piston rod 59. A second sensor 57 detects that the piston rod 59 is back in its original position, thereby indicating to the main CPU 3 that the reject station function is complete and that the disc 4 can be rotated without interference at the reject station. When a tube 32 is rejected, the CPU 3 stores that information in a register such as a Random Access memory (RAM) to prevent the clean-out, filling, sealing, trimming or eject functions from occurring when the empty tube holder 10 arrives.

Alternatively, if a tube 32 is properly oriented in the orientation station 14, no action occurs at the reject station 16.

Simultaneously, the preceding (if not rejected) tube 32 is being cleaned at the cleaning station 18. The cleaning nozzle 69 is vertically lowered into the empty tube 32. Simultaneously the nozzle blows and vacuums for a predetermined amount of time, i.e. 0.5 seconds. At the end of this period of time the cleaning nozzle 69 is elevated to its original rest position which sets off a sensor 71. The sensor 71 indicates to the CPU 3 that this task is complete and the disc 4 can be rotated without interference from the apparatus at the cleaning station 18.

The next station is the filling station 20. If the tube 32 entering this station has not flaged as an unoriented, rejected tube the main CPU 3 signals to the pneumatic system 100, which in turn activates an oil system 105 to lower the fill nozzle 66 into the tube 32. Sensor 63 detects when the fill nozzle 66 is lowered causing the computer driven motor controller 85 to read the fill weight and speed of the pump motor, the fill line 64 of the fill nozzle 66 to open and the pump motor to begin pumping. The oil lines have a cut-off valve 88 and a flow control valve 87. When the fill nozzle 66 is opened, the nozzle rises immediately thru hydraulic flow control valve 87 for a slow steady speed. When the fill nozzle 66 has completed distributing the product the pump motor CPU 85 sends a signal to the main CPU 3, which opens the second valve 88, causing the fill nozzle 66 to rise to its original position at a faster speed. A sensor 65 detects the return of the fill nozzle 66 to its original position and signals the main CPU that the filling stage 20 is completed and the disc 4 can be rotated.

It has been determined that when filling a "stringy" product a nozzle with a positive cut-off at the bottom of the nozzle functions best. It has also been found that the nozzle should dive into the empty tube and fill as the nozzle slowly rises. Thicker products fill faster when using a larger ball cut-off nozzle that dives slightly into the tube and remains in the tube for the entire length of fill. These functions are switch selectable from the control panel to the CPU 3 which will determine and control the manner of rise of the nozzle 66.

Simultaneously, the previously filled tube 32 is being sealed at the sealing station 22 provided the tube is not flaged. The main CPU 3 sends a signal to the sealing mechanism to initiate the process. The sealing mechanism then signals the main CPU 3 when the process is complete.

To ensure uniformity, the top of the previously sealed tube 32 is trimmed at the trimming station 24. Two trim or clipping blades 90 and **90*a* which are pneumatically activated move horizontally, clipping off the excess of the tube 32 beyond the seal line. A sensor 92 detects when the trim blades 90 and 90*a* are fully extended. A second sensor 94 detects that the blades 90 and 90*a* have returned to their original rest position and signals the main CPU 3** that the trimming process is complete.

The previously filled, sealed, trimmed tube is simultaneously being ejected. The pneumatically operated piston 98, extends vertically through the opening 180 in the bottom of the tube support member 8, forcefully raising the tube 32 upwardly so that the tube 32 hits the deflector 83 and then proceeds down a chute 84 into a collection container and outwardly beyond the outer edge 5 of the disc 4. The sensor 93 detects the up position of the piston 98. The sensor 96 detects the return of the eject piston 98 to the rest position and signals the CPU 3 that rotation of the disc 4 can occur without interference at the eject station 26.

Between the eject station 26 and the load station 12 a conventional light emitting diode 28 is positioned. When the disc 4 rotates, the diode checks to determine if a tube 32 is still in the tube support member 8. If a tube 32 is detected, the apparatus is automatically stopped until the tube 32 is removed and a start signal from the control panel is sent.

All of the functions at the respective stations are performed simultaneously.

Each station is also capable of running independently of each other thus allowing for testing, set-up and repair of each station separately.

If the sensor 21 indicates that there are no more tubes 32 or someone has decided to initiate the end cycle from the control panel, each task beginning with the load task 12 will sequentially stop so that the tubes 32 currently on the disc 4 will be completed and the filling machine 2 will come to a complete stop.

Figures 13, 13A:
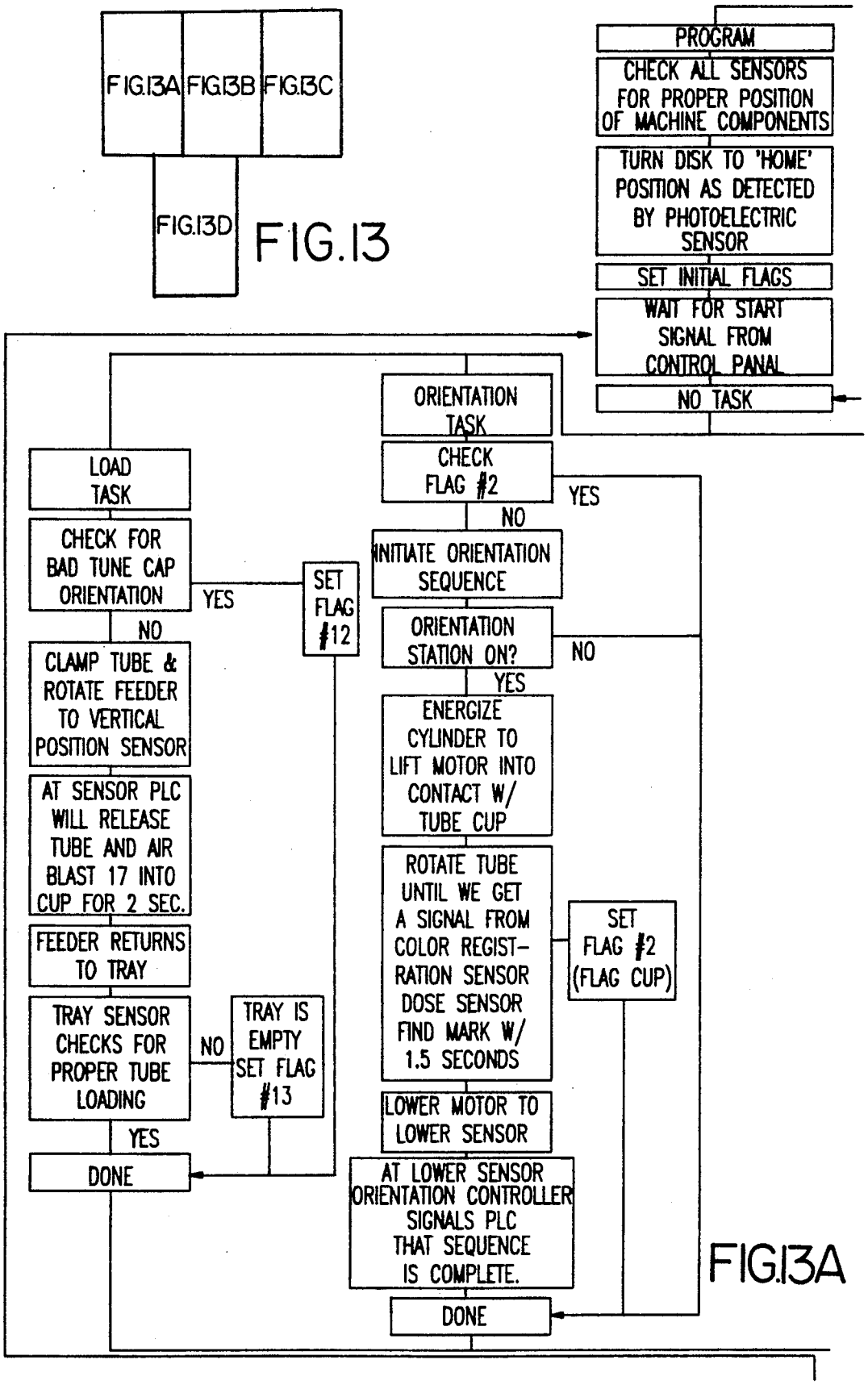
FIG. 13 is a flow chart of the control of the filling machine of FIG. 1.
Figure 13B:
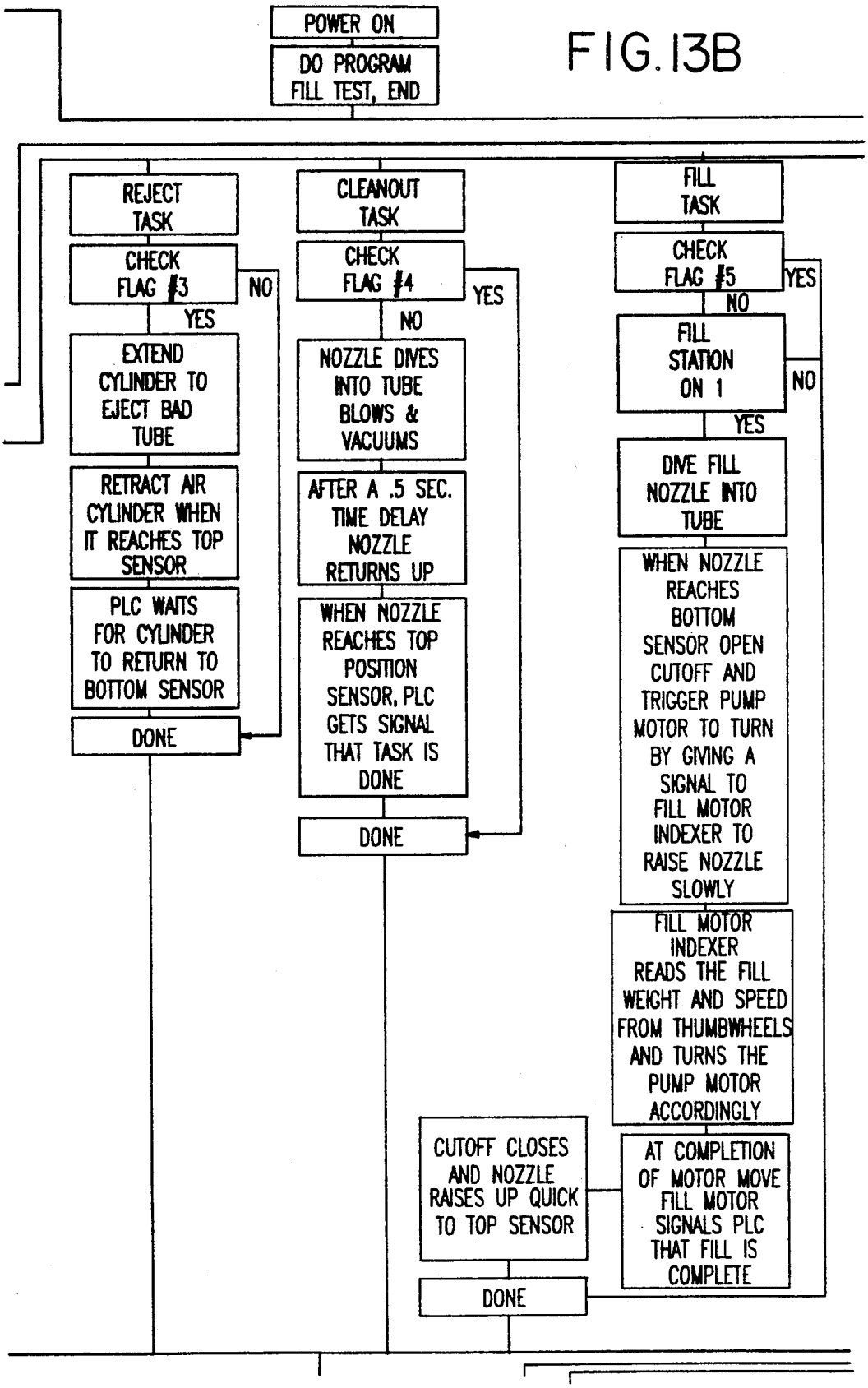
Figure 13C:
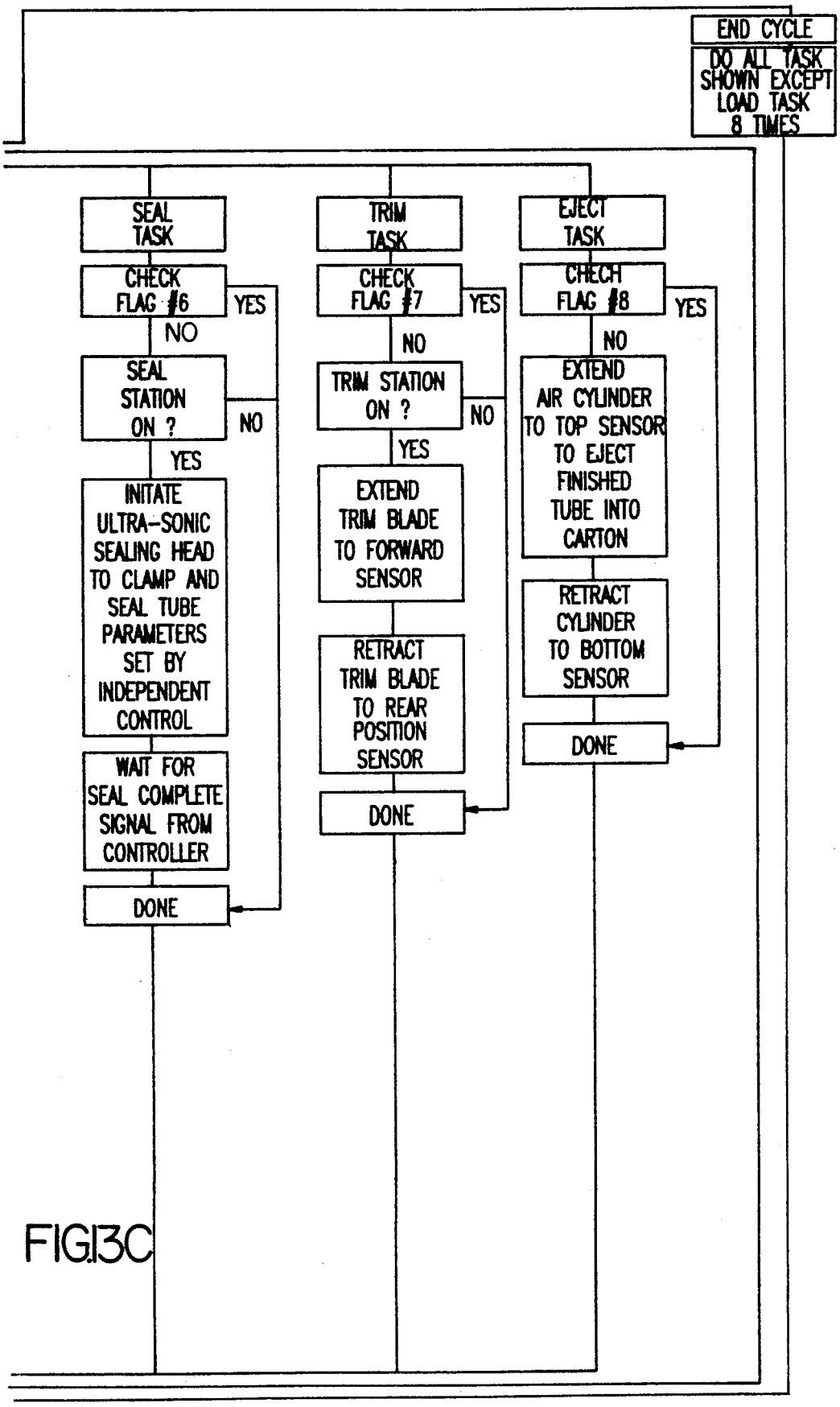
Figure 13D:
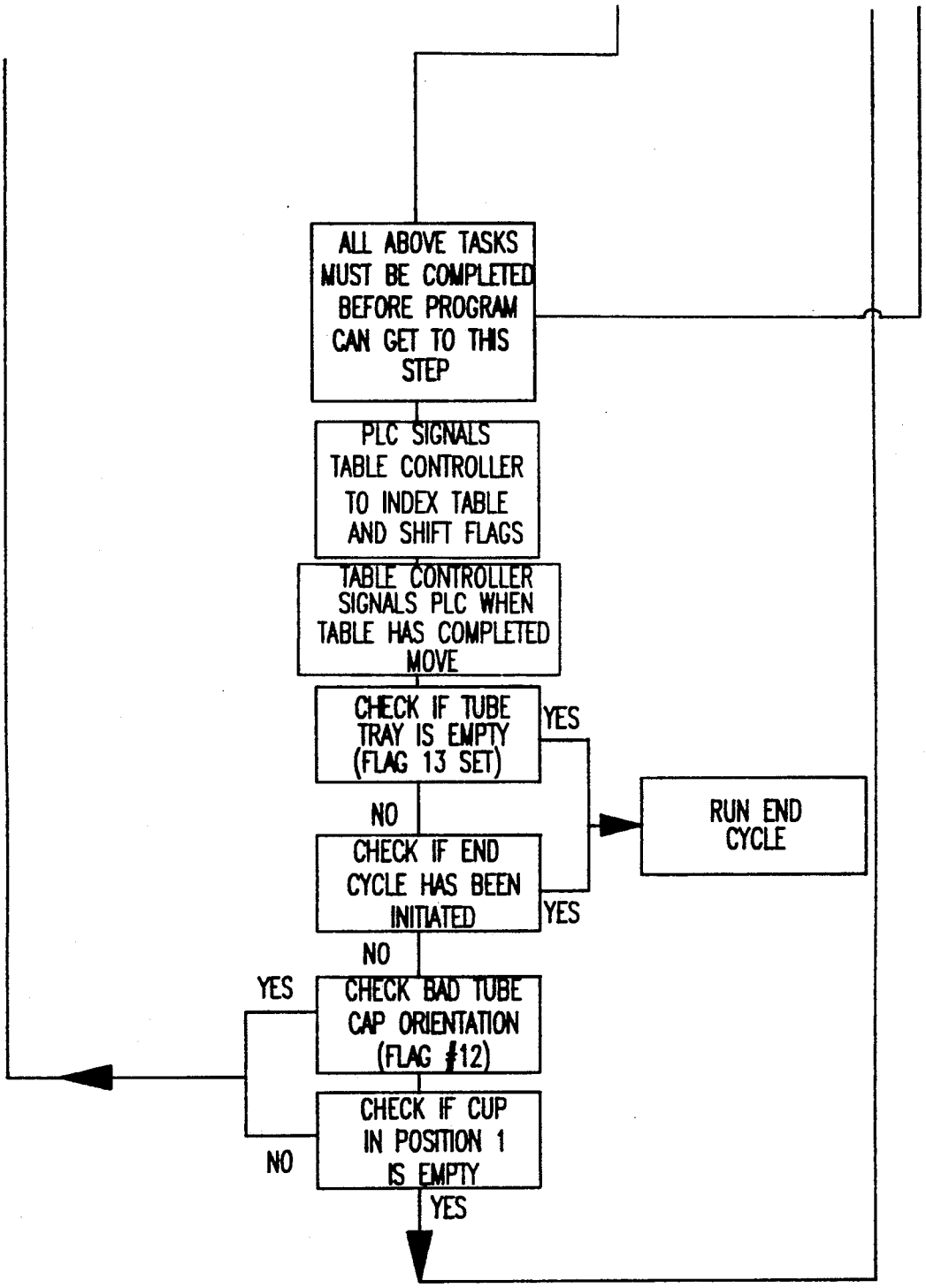

FIG. 13 illustrates the programmed process of the CPU 3 in the form of a self explanatory flow chart.

We claim:

1. An apparatus for filling tubes comprising:

a) means for moving a tube serially to a plurality of work stations;

b) means for delivering empty tubes having a fill opening to the means for moving a tube serially to a plurality of work stations;

c) means for orienting a tube to provide a desired orientation for subsequent work stations;

d) means for filling a tube;

e) mean for sealing the fill opening on the tube after a tube has been filled; and f) means for removing a sealed filled tube from the means for moving a tube serially to a plurality of work stations;

wherein the means for delivering empty tubes to the means for moving tubes serially to a plurality of work stations is comprised of sensor means for detecting if a tube exists and is correctly positioned, a pivotally mounted carriage, means for releasably retaining an empty tube to the carriage, means for pivoting the carriage to deliver the empty tube to the means for moving tubes serially to a plurality of work stations and means for positively securing the empty tube to the means for moving the tubes serially to a plurality of work stations.

2. An apparatus for filling tubes comprising:

a) means for moving a tube serially to a plurality of work stations;

b) means for delivering empty tubes having a fill opening to the means for moving a tube serially to a plurality of work stations;

c) means for orienting a tube to provide a desired orientation for subsequent work stations;

d) means for determining if the desired orientation is achieved before filling an empty tube;

e) means for removing an empty tube that has not been oriented as desired from the means for moving a tube serially to a plurality of work stations before filling the empty tube;

f) means for filling a tube;

g) means for sealing the fill opening on the tube after a tube has been filled; and h) means for removing a sealed filled tube from the means for moving a tube serially to a plurality of work stations.

3. An apparatus as in claim 2 further comprising means for trimming the edge of a tube beyond the sealed fill opening.

4. An apparatus as in claim 2 wherein the means for moving a tube serially to a plurality of work stations comprises a disc, an indexing servo motor for rotating the disc, a plurality of holes located radially equidistant from the center of the disc; means located in the holes for holding a tube and means for controlling the rotation of the disc.

5. An apparatus as in claim 4 further comprising a bearing sleeve at the periphery of a hole and wherein the means for holding a tube is comprised of a cylindrical body support member, a flange collar extending from the cylindrical body support member, a removable tube holding member and means on the cylindrical body member to releasably retain the removable tube holding member to the cylindrical body member.

6. An apparatus as in claim 5 further comprising a centrally disposed opening extending axially through the cylindrical body support member and the removable tube holding member.

7. An apparatus as in claim 4 wherein the means for controlling the rotation of the disc is a central processing unit, a plurality of strategically located sensors and an actuation system for performing work functions.

8. An apparatus as in claim 7 wherein the actuator system is comprised of pneumatic actuators, pneumatic actuation lines and electrical solenoid valves in each line controlled by the central processing unit.

9. An apparatus as in claim 1, wherein the means for filling a tube is comprised of a source of fill material, a pump, an inlet line from the source of fill material to the pump, an outlet line from the pump terminating in a nozzle, means for inserting the nozzle into the empty tube and energizing the pump to deliver material from the fill source to the tube.

10. An apparatus as in claim 2 wherein the means for determining if the desired orientation of an empty tube has been achieved is comprised of a sensing device for locating an orientation mark on the empty tube; a stepper motor for rotating the empty tube in the path of the sensing device and means for determining if the sensing device locates the orientation mark within a pre-determined period of time.

11. An apparatus as in claim 10, wherein the means for removing an empty tube that has not been properly oriented is comprised of a reject piston and piston rod; means for vertically aligning the piston rod with the empty tube; means for actuating the piston to drive the piston rod into the bottom of the empty tube in response to a signal that the empty tube is not properly oriented.

12. An apparatus as in claim 1, further comprising means for cleaning the empty tube.

13. An apparatus as in claim 12, wherein the means for cleaning the empty tube is comprised of an air blower, a vacuum line and means to selectively insert the air blower and vacuum line into the empty tube, energize the air blower and vacuum line when in the empty tube and to retract the air blower and vacuum line from the empty tube while cleaning.

14. An apparatus as in claim 9 wherein the means for inserting the nozzle into the empty tube and energizing the pump to deliver material from the fill source to the tube comprises means for inserting the nozzle slightly into the empty tube and for allowing the nozzle to remain stationary while filling the tube with fill material.

15. An apparatus as in claim 9, further comprising means for simultaneously performing a plurality of work functions.

16. An apparatus as in claim 9 wherein the means for inserting the nozzle into the empty tube and energizing the pump to deliver material from the fill source to the tube comprises means for inserting the nozzle substantially into the empty tube and for elevating the nozzle while filling the tube with fill material.

17. An apparatus as in claim 9 wherein the means for inserting the nozzle into the empty tube and energizing the pump to deliver material form the fill source to the tube comprises first means for inserting the nozzle slightly into the empty tube and for allowing the nozzle to remain stationary while filling the tube with fill material, second means for inserting the nozzle substantially into the empty tube and for elevating the nozzle while filling the tube with fill material, and switching means for selecting the first means or the second means.

18. An apparatus for filling tubes having a plurality of work stations for performing individual functions and a rotating disc to sequentially deliver a tube to be filled to the work stations, the improvement comprising a circular hole in the disc, a sleeve made from adhesive plastic held in place by a set screw and a tube support member having a cylindrical hollow body, a hole at the top and bottom and a flange of essentially the same dimension as the collar of adherent material whereby the flange rests on the adherent material in a fixed orientation after orienting the tube support member to a desired orientation for subsequent functions.

19. An apparatus as in claim 18, further comprising aligned holes in the top and bottom of the cylindrical tube holding member and means for selectively holding various size tube holding members.

20. In an apparatus for filling tubes comprised of a circular disc having tube holding means and a plurality of work stations, the improvement comprising a central processing unit; an actuation system for initiating the functions at the work stations and means for communicating signals between the central processing unit and the actuation system, wherein the means for providing communication between the central processing unit and the actuating system is comprised of an array of sensors strategically located at the work stations and the means for initiating the functions at the work stations is comprised of pneumatic actuators, and wherein the plurality of workstations comprise means for loading empty tubes on the disc; means for orienting the empty tube to provide a desired orientation; means for determining if the desired orientation is achieved before filling an empty tube; means for rejecting empty tubes that are not oriented as desired; means for cleaning the empty tubes; means for filling the tubes; means for sealing the fill opening after the tube has been filled; means for trimming the tube material beyond the seal and means for ejecting the filled tubes.

21. A method for filling tubes comprising the steps of:

a) loading a empty tube onto a working station;

b) orienting the tube to a desired orientation;

c) determining if the desired orientation of the tube has been achieved;

d) rejecting a tube that has not been oriented to the desired orientation;

e) filling the tube;

f) sealing the fill opening on the tube after the tube is filled; and g) ejecting the filled sealed tube.

22. A method as in claim 21 further comprising the steps of cleaning the empty tube before filling the tube and trimming the filled tube after it has been sealed.

23. A method as in claim 22 further comprising the step of certifying that tubes do not travel beyond the ejection stage.

24. A method as in claim 21 wherein the step of loading an empty tube onto a working station comprises the further steps of providing a tube holder at the working station; and providing means to move the empty tube from a delivery area to the tube holder.

25. A method as in claim 21 wherein the tube has a registration orientation mark and the step of orienting a tube further comprises rotating the tube about a vertical axis and viewing the rotating tube with a sensor to determine if the orientation mark is at a desired location.

26. A method as in claim 21, wherein the step of filling the tube comprises the step of inserting a fill nozzle substantially into the empty tube and elevating the nozzle as the tube is being filled.

27. A method as in claim 21 further comprising the steps of rotating the tubes to be filled sequentially to the work stations, stopping the tubes at each work station, performing the work at each station simultaneously and determining that the apparatus for performing the various work functions have completed the work function and are in a position that does not interfere with rotation of the tubes to the next work station.

28. A method as in claim 27, wherein the step of determining that the work functions have been completed and are in a position that does not interfere with rotation of the tubes to the next work station is performed by an array of strategically located sensors that provide signals to a central processing unit that control the implementation of the work stations and the rotation of the tubes sequentially to the work stations.

29. A method as in claim 21, wherein the step of filling the tube comprises the step of inserting a fill nozzle slightly into the empty tube and allowing the nozzle to remain stationary while filling the tube with fill material.

30. A method as in claim 21, wherein the step of filling the tube comprises the step of selecting between the steps of inserting a fill nozzle slightly into the empty tube and allowing the nozzle to remain stationary while filling the tube with fill material, or inserting a fill nozzle substantially into the empty tube and elevating the nozzle while filling the tube with fill material.

* * * * *

UNITED STATES PATENT AND TRADEMARK OFFICE

CERTIFICATE OF CORRECTION

PATENT NO. : 5,209,044

DATED : May 11, 1993

INVENTOR(S) : James D'Addario and Steven T. Murray

It is certified that error appears in the above-identified patent and that said Letters Patent is hereby corrected as shown below:

Column 11, line 17, "1" should read -- 2 --.
Column 11, line 40, "1" should read -- 2 --.
Column 11, line 67, "form" should read -- from --.

Signed and Sealed this

Fifteenth Day of March, 1994

Bruce Lehman

*Attest:*

BRUCE LEHMAN

*Attesting Officer*

*Commissioner of Patents and Trademarks*